US005829070A

United States Patent [19]

Taylor

[11] Patent Number: 5,829,070

[45] Date of Patent: Nov. 3, 1998

[54] BATHTUB SEAT APPARATUS

[76] Inventor: Marian Taylor, 424 W. 48th St., New York, N.Y. 10036

[21] Appl. No.: 694,376

[22] Filed: Aug. 8, 1996

[51] Int. Cl.[6] ..... A47K 3/12

[52] U.S. Cl. ..... 4/578.1; 4/579; 4/583

[58] Field of Search ..... 4/571.1, 573.1, 4/575.1, 578.1, 579, 581, 582, 583

[56] References Cited

U.S. PATENT DOCUMENTS

| | | | |
|---|---|---|---|
| D. 210,014 | 1/1968 | Heckethorn . | |
| D. 225,817 | 1/1973 | Torrey . | |
| D. 245,861 | 9/1977 | Elder . | |
| D. 264,163 | 5/1982 | Chapman . | |
| D. 267,969 | 2/1983 | Rodger . | |
| D. 268,280 | 3/1983 | Rodger . | |
| D. 320,528 | 10/1991 | Bernstein et al. . | |
| 1,039,334 | 9/1912 | Trick | 4/575.1 |
| 1,352,733 | 9/1920 | Egerton . | |
| 1,898,272 | 2/1933 | Stern | 4/575.1 |
| 2,167,178 | 7/1939 | Kohlstadt | 4/575.1 |
| 2,541,029 | 2/1951 | Burton | 4/573.1 |
| 3,078,474 | 2/1963 | Chaitlen | 4/575.1 |
| 3,418,668 | 12/1968 | Anderson et al. . | |
| 4,047,259 | 9/1977 | Lotis . | |
| 4,266,306 | 5/1981 | Lee . | |
| 4,407,029 | 10/1983 | Schmidt . | |
| 4,495,666 | 1/1985 | Herman, Jr. . | |
| 4,574,409 | 3/1986 | McAffrey . | |
| 4,644,592 | 2/1987 | Small . | |
| 4,837,871 | 6/1989 | Wheeler . | |
| 4,939,799 | 7/1990 | Van Hovel . | |
| 5,010,606 | 4/1991 | Bernstein et al. . | |
| 5,054,136 | 10/1991 | Imagaki . | |
| 5,080,091 | 1/1992 | Peterson et al. . | |
| 5,158,460 | 10/1992 | Bernstein et al. . | |
| 5,216,764 | 6/1993 | Hall et al. . | |
| 5,357,639 | 10/1994 | Zellner . | |
| 5,371,958 | 12/1994 | Brosseau . | |
| 5,375,271 | 12/1994 | Frankel . | |
| 5,388,286 | 2/1995 | Davenport . | |
| 5,535,458 | 7/1996 | Siverly | 4/573.1 |

OTHER PUBLICATIONS

Advertisement for Daphné Baby Bath Seat, The 1996 Baby Guide, Summer/Fall Edition, p.9.

*Primary Examiner*—Charles R. Eloshway
*Attorney, Agent, or Firm*—Seth H. Ostrow

[57] ABSTRACT

A portable rubber bathtub seat apparatus for comfortably preventing a person from sliding down when in a seated position within a bathtub, the apparatus being supported by the bottom surface of the bathtub. The apparatus has a generally thin, flat back section upon which the person sits when the apparatus is supported on the bottom surface of the bathtub, a raised front section having a thickness substantially greater than the thickness of the back section and adequate to support all or part of the legs of the person, the front section having a cavity in the undersurface thereof, a gradually sloping transition area between the back and front sections, and a plurality of suction cups coupled to the front section and positioned within the cavity for releasably securing the apparatus to the bottom surface of the bathtub such that the apparatus is prevented from sliding in relation to the surface while a person is seated on the apparatus. The apparatus may also be designed and used for other applications, such as for children's high chairs and other seat structures.

2 Claims, 3 Drawing Sheets

BATHTUB SEAT APPARATUS

COPYRIGHT NOTICE

A portion of the disclosure of this patent document contains material which is subject to copyright protection. The copyright owner has no objection to the facsimile reproduction by anyone of the Patent document or the patent disclosure, as it appears in the Patent and Trademark Office patent files or records, but otherwise reserves all copyright rights whatsoever.

BACKGROUND OF THE INVENTION

The invention disclosed herein relates generally to seating devices and to bathtub mats, More particularly, the present invention relates to a bathtub mat configured to prevent a person sitting in the bathtub from undesirably slipping and sliding down into the tub.

It is well known that bathtubs are slippery and present a great risk of injury to someone standing in the tub, especially in the presence of water and soap. This is because bathtubs are generally made of a material, such as acrylic, cast-iron porcelain, steel and polymer, etc., which does not have a high enough coefficient of friction with human skin. In attempts to compensate for this problem, various bathtub mats or strips are available which provide an increased resistance to slipping while standing in the tub and thus minimize the risk that someone standing in a bathtub will slip and fall.

However, a problem which to the inventor's knowledge has not so far been addressed is the slipping and sliding that occurs when sitting in a bathtub. Sliding down into the water while sitting in the tub is both uncomfortable and even potentially unsafe, especially when people fall asleep in the bath.

When sitting in the tub, people usually lean their backs against the side or wall of the tub on one end and support their bodies in place by propping their feet up against the opposing side or wall. However, in many cases people can not support their bodies with their legs and feet. For example, shorter people and children may not have legs long enough to reach the opposite end. Also, certain types of bathtubs, such as whirlpools and Jacuzzis, are too large for people to sit on one side and reach the opposite side. Furthermore, many tubs have faucets, drains and other fixtures on one end which are uncomfortable to rest feet upon.

Because substantial lateral force is exerted on a person's body when leaning against the back wall of the tub, conventional bath mats, designed to minimize slipping when stood upon and thus when mostly transverse force is applied, are inadequate to prevent slipping while sitting in the tub. Thus, there is a need for an apparatus which prevents a person from slipping and sliding down into the water in a bathtub while sitting in the bathtub, and which helps keep the person in a stationary position within the tub.

Moreover, other circumstances exist in which it is undesirable for a person sitting on a surface to slip and slide down the surface. For example, a child sitting in a high chair tends to slip down and out of the chair, either unintentionally or in a purposeful effort to escape the restraints of the high chair. Similarly, many small children slide down and slip out of seats, such as those in cars or buses, which are designed for adults and thus are too large for children to sit comfortably and support themselves with their feet on the floor. There is thus a further need for an apparatus which helps support people when sitting on a seat and prevents them from slipping down or out of the seat.

SUMMARY OF THE INVENTION

It is an object of the present invention to provide support for a person sitting on a surface and leaning their back against a wall or seat back to prevent the person from sliding down the surface.

It is another object of the present invention to provide a portable apparatus for securely retaining people in seated positions on slippery surfaces.

It is another object of the present invention to provide an apparatus for preventing people from sliding down into the water in a bathtub during a bath.

It is another object of the present invention to provide an apparatus for preventing children from sliding out of high chairs or other seats in which they can not support themselves with their feet on the floor.

The above and other objects are achieved by an apparatus for preventing a person from sliding down when in a seated position on a surface such as a bathtub floor or other seat, the undersurface of the apparatus being supported on the surface. The apparatus comprises a generally thin, flat back section upon which the person sits when the apparatus is supported on the surface, a raised front section having a thickness adequate to support all or part of the legs of the person in response to a force component applied to the person's body in the general direction in which the person's legs point, and retaining means for releasably securing the apparatus to the surface such that the apparatus is prevented from sliding in relation to the surface.

A person sits on the back section of the apparatus and rests part of his or her legs on the front section, which thus prevents the person from slipping or sliding down in the direction in which his or her legs are pointing.

Although the size and relative proportions of the sections of the apparatus may vary according the desired use of the apparatus, the back section should be sufficiently large to support the person's buttocks and the front section should be sufficiently high to support the person's legs and resist movement of the person in response to a nonperpendicular force component resulting, for example, when the person leans against the back of the tub or other structure.

In some embodiments, the retaining means comprises at least one suction cup coupled to the undersurface of the apparatus, and preferably comprises a plurality of suction cups coupled to the undersurface of the front section. The front section may have a cavity on the underside thereof and the suction cups may then be positioned substantially or entirely within the cavity. Alternatively, the retaining means may comprise a rubber material composing at least the undersurface of the apparatus, which produces friction between the undersurface and the surface such as the bathtub floor. The retaining means may comprises further alternatives, such as adhesive or Velcro coupled to the undersurface of the apparatus or rope connected to the side or undersurface of the apparatus for tying the apparatus to a stationary object such as the back of a chair.

When made for use in a bathtub, the apparatus is made of a water proof material such as silicone rubber. This provides the added advantage of flexibility, thus making the apparatus easier to fold or roll and carry. When produced for other applications, the apparatus may be made of rubber or other suitable materials such as wood or plastic.

In some embodiments, the apparatus comprises a gradually sloping transition area between the back section and the front section. Alternatively, the apparatus may have a sharp abrupt junction between the front and back sections.

Some of the above and other objects of the present invention are also achieved by a bathtub mat comprising a generally planar rear portion of generally uniform thickness, a front portion having a thickness substantially greater than the thickness of the rear portion, a sloped transition area between the rear and front portions, and retaining means coupled to the undersurface of the mat for releasably securing the mat to the bottom surface of a bathtub. In some embodiments, the rear portion of the mat has a thickness of approximately one eighth of an inch and the front portion has a thickness of approximately one inch, and the mat is approximately twelve inches in length. The bathtub mat is preferably made of a water proof material such as silicone rubber, and may be molded as a single piece.

In some embodiments, the front portion of the mat has an indentation in the undersurface thereof and the retaining means comprises a plurality of suction cups coupled to the undersurface of the front portion and positioned at least partly within the indentation.

BRIEF DESCRIPTION OF THE DRAWINGS

The invention is illustrated in the figures of the accompanying drawings which are meant to be exemplary and not limiting, in which like references refer to like or corresponding parts, and in which.

DETAILED DESCRIPTION OF THE PREFERRED EMBODIMENTS

Figure 1:
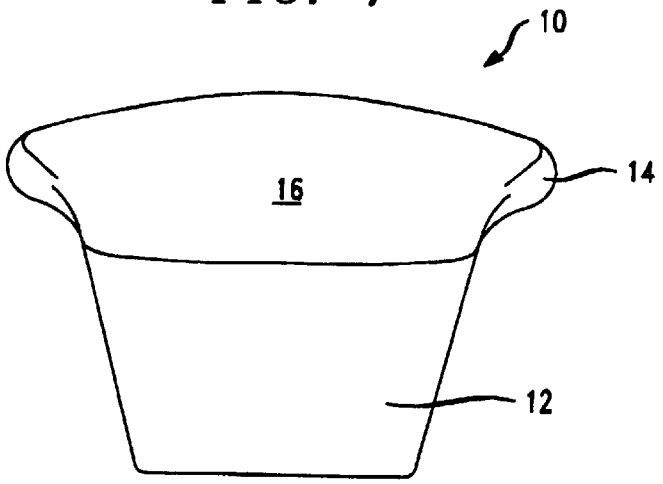
FIG. 1 is a top perspective view of one embodiment of the apparatus of the present invention.
Figure 2:
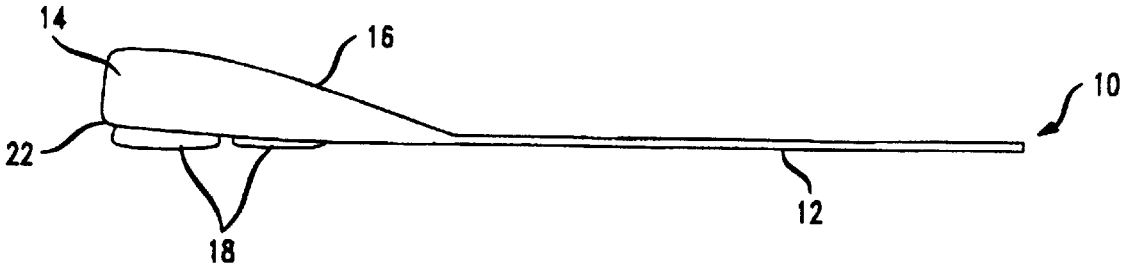
FIG. 2 is a front view of the apparatus of FIG. 1.

With reference to FIGS. 1–5, one preferred embodiment of the seat apparatus 10 of the present invention comprises a back or rear portion 12 which is generally flat and thin, a raised front portion 14, and a gradually sloping transitional area 16 between the front portion 14 and rear portion 12. The rear portion 12 has a thickness of about one eighth (0.125) of an inch and the raised front portion 14 has a height of about one inch.

In one embodiment for use by an adult of about average height, the apparatus is about 12 inches in length, with the front portion 14 and transition area 16 being about 2.5 inches long and the rear portion 12 being about 9.5 inches long. The width of the rear portion 12 varies between 7.875 inches at the narrow end to about 9.875 inches at the point at which the rear portion 12 meets the transition area 16. The raised portion 14 is about 11.25 inches wide at the widest point on top and about 11.75 inches wide at the widest point on the bottom.

Figure 6:
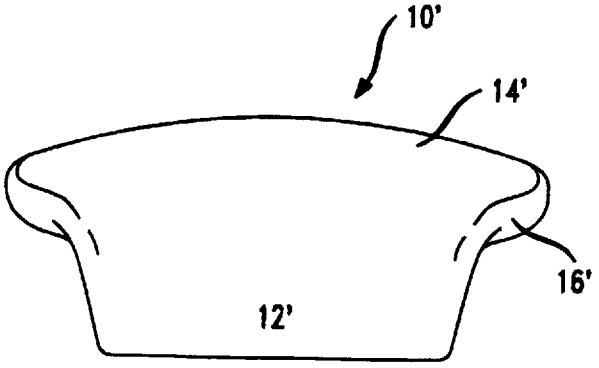
FIG. 6 is a top perspective view of another embodiment of the present invention.

One skilled in the art will recognize that the dimensions of the apparatus 10 may be varied according to the desired need and use of the apparatus. For instance, an apparatus for use by a child would require smaller dimensions than those for an adult. FIG. 6 shows an apparatus 10', which may be suitable for use by a child, having a smaller rear portion 12' and which have a smaller front portion 14' and transition area 16'.

In addition, one skilled in the art will recognize that the apparatus 10 or 10' may have a different overall shape, e.g., may be square, rectangular, triangular, etc., and that the relative proportions of the different sections may be different depending upon the specific application and aesthetic considerations. For example, aesthetic considerations factor into the design of the embodiment shown in the drawings having, among other things, a generally obround front section 14 and a gently tapering back section 12.

When produced for use in a bathtub, the apparatus 10 is made of a water proof material such as silicone rubber or other conventional material used in the manufacture of bathtub mats. The entire apparatus may then be produced as a single molded piece in a manner well known in the art. For use in other applications, such as in a high chair, the apparatus may be made of rubber, wood, plastic, or any other material which generally retains its shape in the presence of a force, and may be coated with a layer of felt, suede, or other material to increase the coefficient of friction between the apparatus and human skin or conventional clothing materials such as cotton and polyester, and to enhance the comfort of the person sitting on the apparatus.

Figure 3:
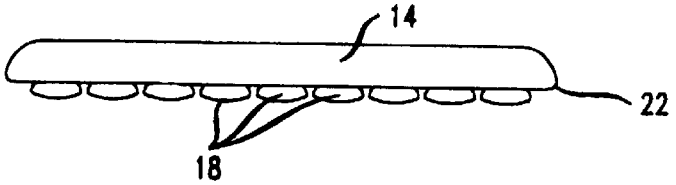
FIG. 3 is a side view of the apparatus of FIG. 1.
Figure 4:
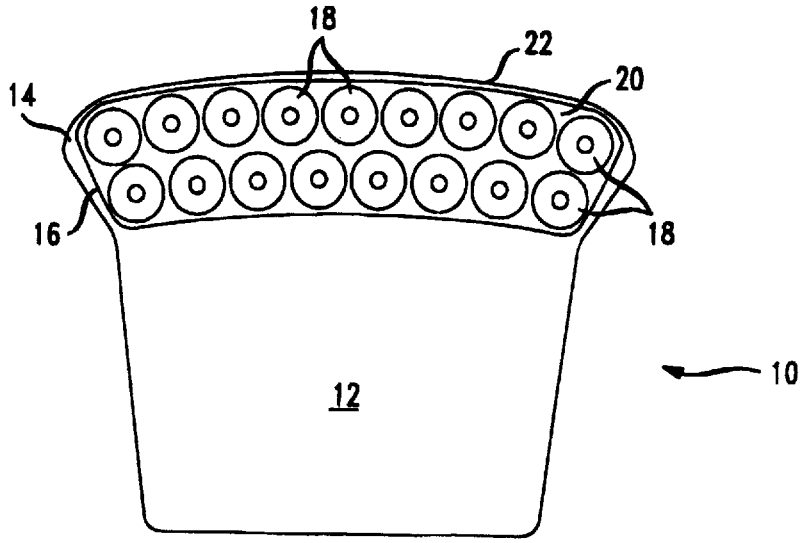
FIG. 4 is a bottom view of the apparatus of FIG. 1.
Figure 5:
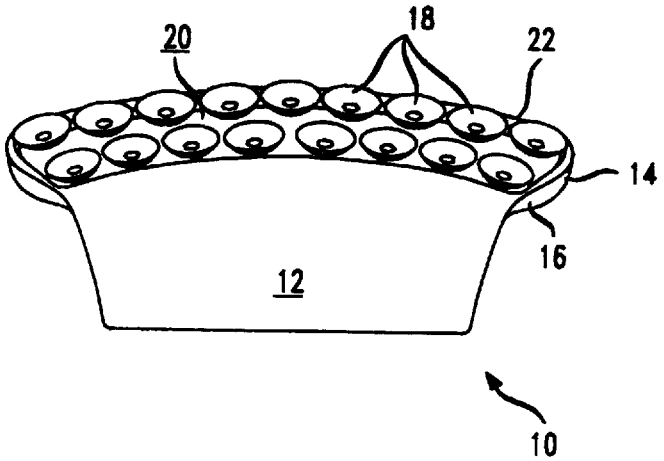
FIG. 5 is a bottom perspective view of the apparatus of FIG. 1.

In one embodiment of the invention, the apparatus is held in place on the floor of a bathtub when a person is sitting thereon by virtue of the friction between the rubber undersurface of the apparatus 10 and the bottom surface of the tub. Alternatively, as shown in FIGS. 2–5, the apparatus 10 has a number of suction cups 18 coupled to the undersurface of the apparatus 10. The raised front portion 14 has a cavity 20 (best seen in FIG. 5) in its undersurface, and the suction cups 18 are positioned within the cavity 20 and extend partially beyond the lip 22 of the cavity 20 to be releasably secured to the floor of the tub. As shown in FIGS. 3 and 4, one preferred embodiment of the invention has two rows of suction cups 18, one row with nine suction cups 18 and the other row having eight suction cups. The suction cups 18 have diameters of about 1.25 inches and are located approximately 0.25 inches apart from one another. The suction cups 18 are made of silicone rubber or other convention material and may be molded along with the apparatus 10 as a single piece.

As one skilled in the art will recognize, any number of suction cups may be used depending upon the size of the apparatus and the desired level of retention to the floor. Also, one skilled in the art will recognize that many other types of devices may be used to secure the apparatus to a seat, such as adhesive strips, Velcro, clips, rope, etc., depending upon the nature of the use of the apparatus, the materials of which the apparatus and seat are comprised, and the desired levels of retention, durability, and portability.

Figure 7:
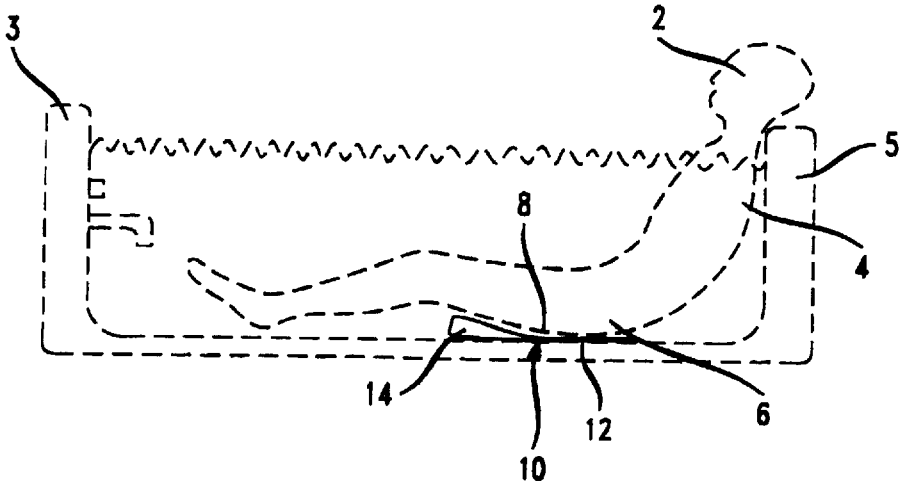
FIG. 7 is a cross-sectional view of a person sitting in a bathtub and using the apparatus of the present invention.

FIG. 7 shows the apparatus 10 as used by a person 2 sitting in a bathtub 3. The apparatus 10 is placed within the tub 3 at an appropriate location, and secured to the floor of the tub 3 by virtue of the suction cups 18 (not shown). The person 2 leans his or her back 4 against the back wall of the tub 3 and positions his or her buttocks 6 on the rear portion 12 of the apparatus 10. The person 2 then rests his or her thighs 8 against the front portion 14 and/or transition area 16, thereby keeping the person 2 stationary within the tub. The use of the apparatus for other applications, such as in a high chair or other seat, will be clear from this exemplary illustration.

While the invention has been described and illustrated in connection with preferred embodiments, many variations and modifications as will be evident to those skilled in this art may be made without departing from the spirit and scope of the invention, and the invention is thus not to be limited to the precise details of methodology or construction set forth above as such variations and modification are intended to be included within the scope of the invention.

What is claimed is:

1. A method of using a portable rubber bathtub seat apparatus to comfortably prevent a person from sliding down when in a seated position within a bathtub, the apparatus having an undersurface which is supported by the bottom surface of the bathtub, the apparatus comprising:

a generally thin, flat back section;

a raised front section having a thickness substantially greater than the thickness of the back section and adequate to support all or part of the legs of the person; and a plurality of suction cups coupled to the undersurface of the apparatus;

the method comprising the steps of:

placing the apparatus within the bathtub by positioning the back section close to a wall of the bathtub and positioning the front section to face away from the wall and in a first direction;

pushing the apparatus down against the surface of the bathtub such that the suction cups securely engage the surface of the bathtub;

the person sitting on the back section with his or her back leaning against the wall of the bathtub and his or her legs extending in the first direction; and the person resting part of his or her legs on the front section to thereby prevent the person from sliding substantially away from the wall in the first direction.

2. A method of using a portable rubber bathtub seat apparatus to comfortably prevent a person from sliding down when in a seated position within a bathtub, the apparatus having an undersurface which is supported by the bottom surface of the bathtub, the apparatus comprising:

a generally thin, flat back section;

a raised front section having a thickness substantially greater than the thickness of the back section and adequate to support all or part of the legs of the person; and a plurality of securing means coupled to the undersurface of the apparatus;

the method comprising the steps of:

placing the apparatus within the bathtub by positioning the back section close to a wall of the bathtub and positioning the front section to face away from the wall and in a first direction;

pushing the apparatus down against the surface of the bathtub such that the securing means securely engage the surface of the bathtub;

the person sitting on the back section with his or her back leaning against the wall of the bathtub and his or her legs extending in the first direction; and the person resting part of his or her legs on the front section to thereby prevent the person from sliding substantially away from the wall in the first direction.

* * * * *